United States Patent [19]

Drost

[11] 4,229,038

[45] Oct. 21, 1980

[54] PORTABLE FOLDING TABLE AND CHAIRS

[76] Inventor: Edward J. Drost, 8101 Kenneth, Skokie, Ill. 60076

[21] Appl. No.: 934,024

[22] Filed: Aug. 16, 1978

[51] Int. Cl.[3] ..... A47B 39/00

[52] U.S. Cl. ..... 297/139; 108/113

[58] Field of Search ..... 108/113; 297/139

[56] References Cited

U.S. PATENT DOCUMENTS

| | | | |
|---|---|---|---|
| 1,457,041 | 5/1923 | Orear | 297/139 X |
| 2,726,711 | 12/1955 | Britt | 297/139 X |
| 4,083,597 | 4/1978 | Dowdy | 108/113 |

*Primary Examiner*—Francis K. Zugel

[57] ABSTRACT

A portable foldable table having twin table top means and support means which are foldable into a compact configuration wherein an opening is provided which is adapted to receive and retain independent articles, such as chairs, therein and which facilitates convenient transport and storage of the folded unit. A portable foldable chair of similar construction adapted to be received and retained within said opening.

1 Claim, 9 Drawing Figures

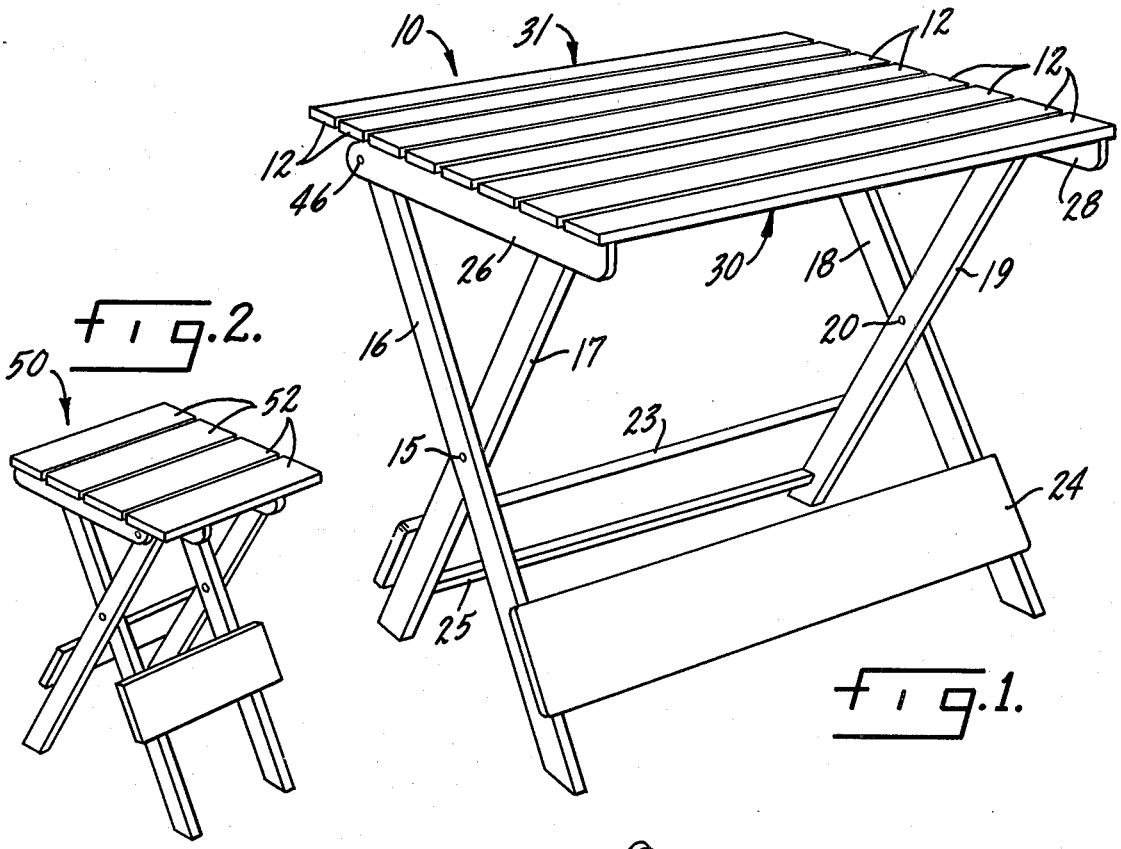
fig.1.
fig.2.
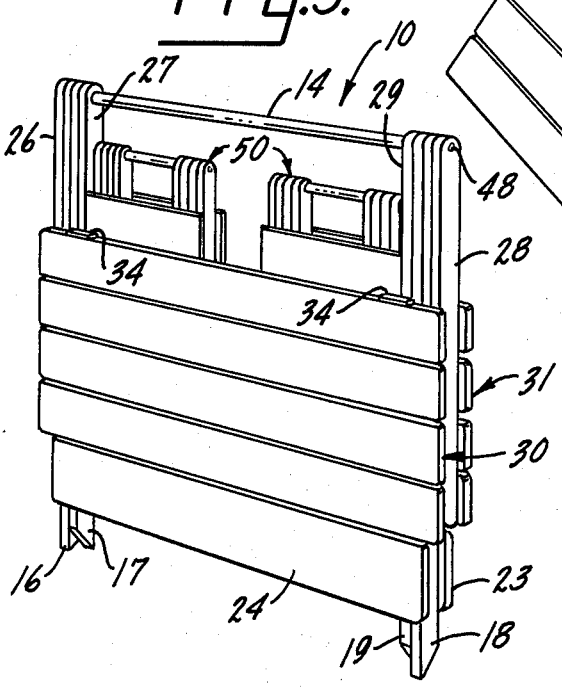
fig.3.
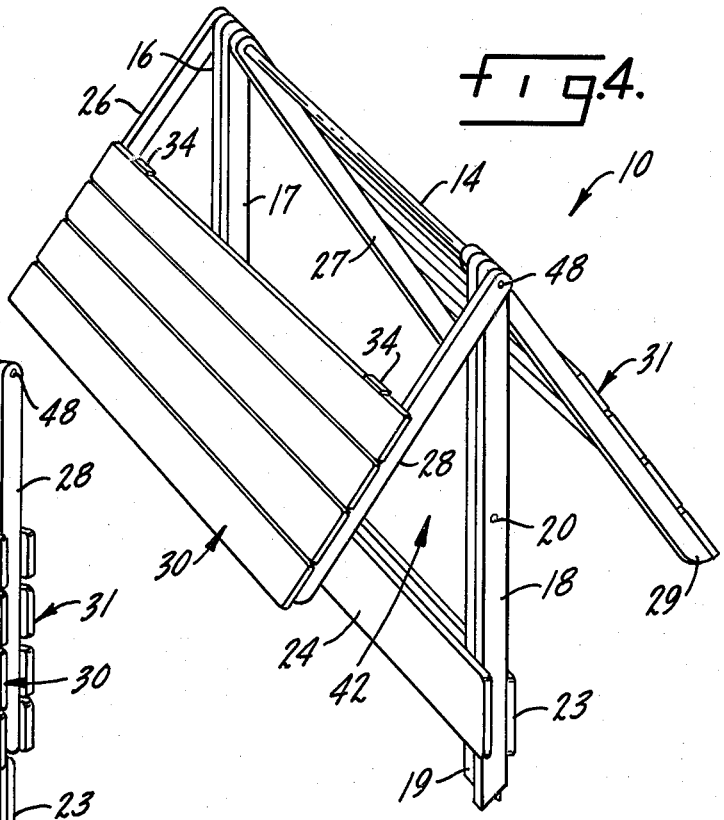
fig.4.

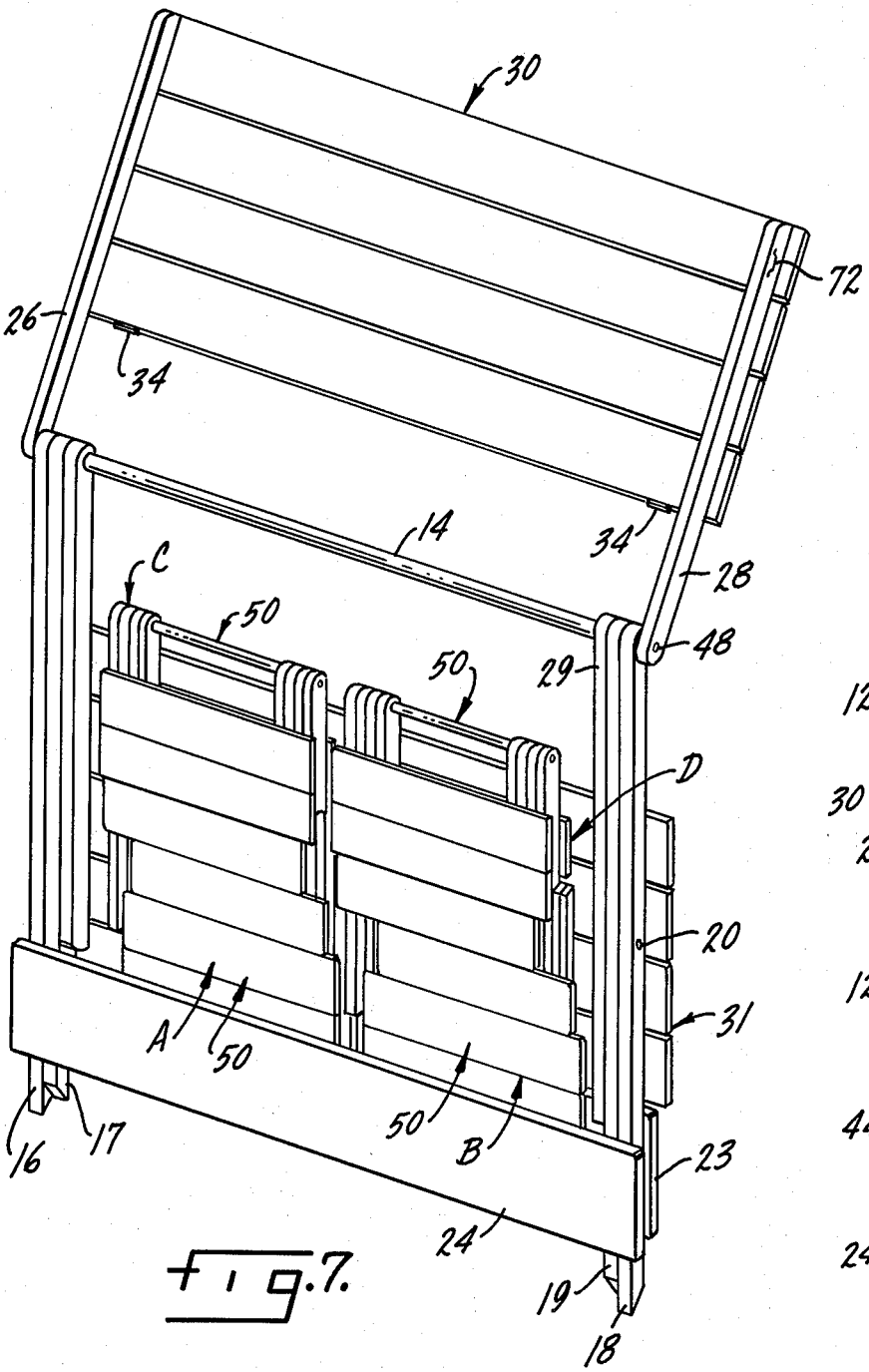
fig.7.
fig.9.
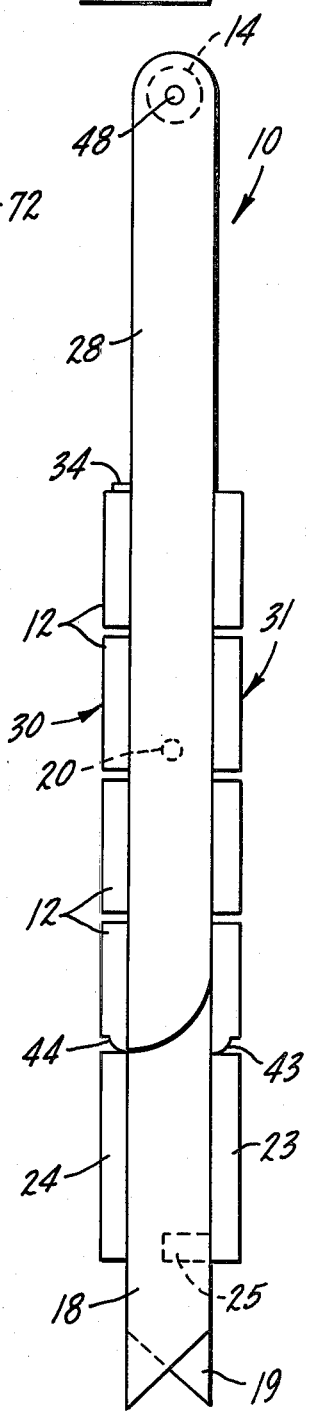

PORTABLE FOLDING TABLE AND CHAIRS

This invention relates to the art of portable, foldable tables and chairs, and specifically to a portable table and chair set made of lightweight material and which can be folded and arranged into a compact unit for convenient carrying and storing.

BACKGROUND OF THE INVENTION

The prior art discloses various types of table and chair sets and, individual tables and chairs, which are useful in out door activities such as camping and picnics as well as in conventional use in a home, backyard or patio. All of these articles, however, share a common disadvantage in that they are not conveniently transportable or storable. Typically, prior art tables and chairs are not foldable into a compact configuration and the components of a table and chair set cannot be arranged to be carried or stored as a compact unit.

This invention overcomes these disadvantages and provides tables and chairs which are useful individually or as a set and which can be folded individually into a highly compact configuration and, when used in a set, can be arranged into a compact unit which is easily transportable and storable.

SUMMARY OF THE INVENTION

Accordingly, a primary object of the invention is to provide an article for use as a table having support means and twin table top means which are arrangeable into a first, open position wherein they form a continuous table top surface and which are arrangeable into a second, folded position wherein said twin table top means are disposed substantially parallel with respect to the support means and with respect to each other so as to form a compact unit which is easily transportable and storable.

Another important object of the invention is to provide an article for use as a table as indicated above with each of said twin table top means having surface means carried by at least one arm member which is pivotally connected to the support means and the support means having oppositely located pairs of leg members, each pair of which is arrangeable into a first, open position corresponding to the first, open position of the twin table top means and is arrangeable into a second, folded position corresponding to the second, folded position of the twin table top means.

Yet another object of the invention is to provide articles for use as chairs having the same features as the articles enumerated above.

Yet another object of the invention is to provide an article for use as a table which in its folded position is adapted to receive and retain independent articles and thereby can be easily transported and stored.

Another primary object of the invention is to provide a table and chair set wherein the table in its folded position is adapted to receive and retain in a central region thereof a plurality of folded chairs so that the set comprises a compact unit which is easily transportable and storable.

Other objects and advantages will be apparent from the following description of the invention.

BRIEF DESCRIPTION OF THE DRAWINGS

The invention is illustrated in the accompanying drawing wherein:

FIG. 1 is a three dimensional view of the table of the invention in an open position.

FIG. 2 is a three dimensional view of the chair of the invention in an open position.

FIG. 3 is a three dimensional view of the table and chairs in a folded position and arranged into a compact unit.

FIGS. 4–6 are three dimensional diagrammatic views showing the folding mechanism of the table.

FIG. 7 is a three dimensional view showing the folded chairs received into the partially folded table.

FIG. 9 is a side view of the table in a folded position.

Like reference numerals will be used to refer to like parts from figure to figure of the drawing.

DESCRIPTION OF THE PREFERRED EMBODIMENT

Figure 5:
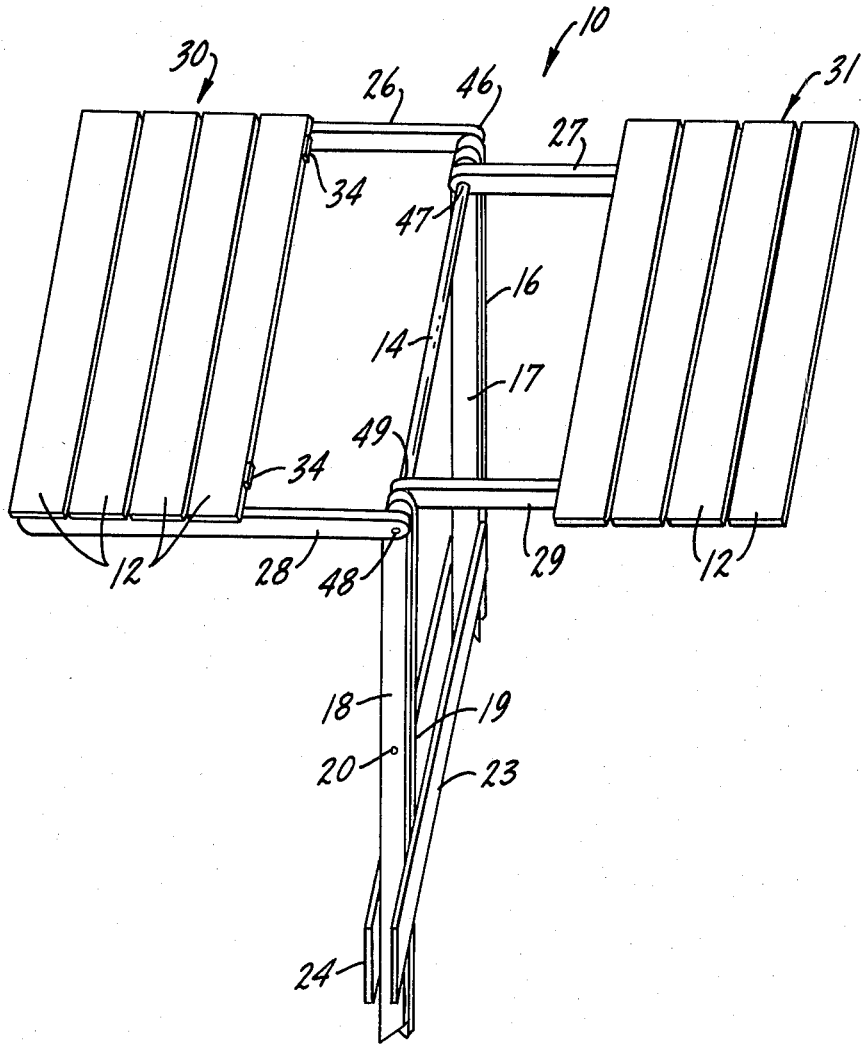

Referring to FIG. 1, the table of the invention is shown generally at 10 in an open usable position having two pairs of oppositely located leg members 16, 17, 18, 19 which provide support for the table top means. The pairs of leg members 16, 17 and 18, 19 are pivotally connected at substantially their central regions by conventional pivot means 15, 20, respectively. Cross members 23, 24 are fixedly attached to the leg members to provide cross stability across the base of the table when in use in an open position. Additional cross stability is provided by cross member 25 which extends between the internal face regions of leg members 17 and 19 and also provides carrying means for chairs or other independent articles retained by the table when it is in a folded position.

Figure 8:
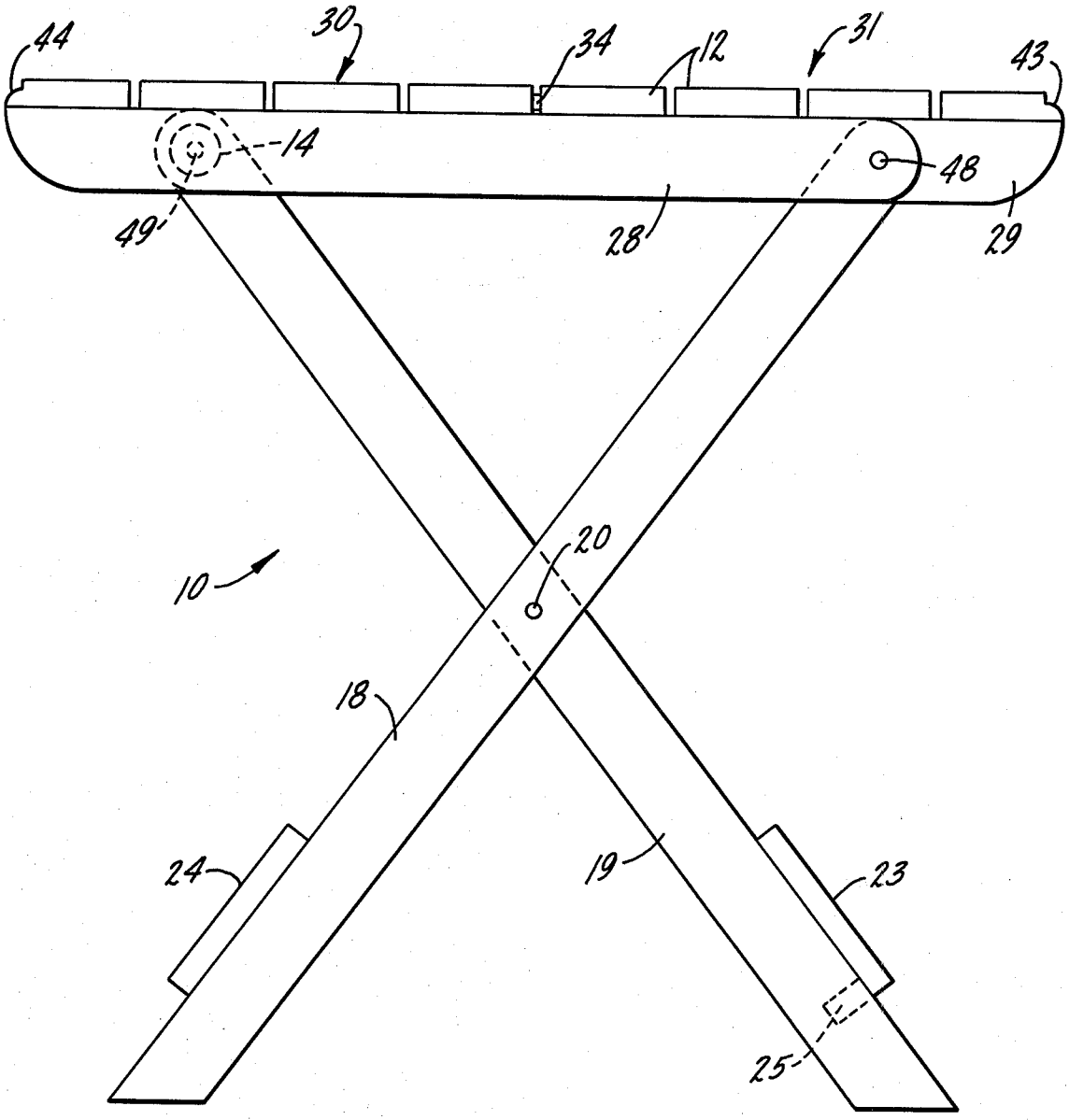
FIG. 8 is a side view of the table in an open position.

As can be seen in FIG. 5, the table top means is comprised of two half sections, shown generally at 30 and 31, having a plurality of conventional surface planks 12 carried by arm members 26, 27, 28, 29. External arm members 26 and 28 are suitably pivotally connected to external leg members 16 and 18, respectively, to facilitate half section 30 to be swung radially with respect to the axis defined by the respective conventional pivot means 46 and 48. Similarly, internal arm members 27 and 29 are suitably pivotally connected to rod 14 and suitably pivotally connected to internal leg members 17 and 19, respectively, to facilitate half section 31 to be swung radially with respect to the axis defined by the center of rod 14. Conventional pivot means 47 and 49, respectively are provided to accommodate these dual pivotal connections and to permit substantially friction free movement between the internal and external leg members at the pivot point. Referring to FIG. 8, it will be noted that when the table is in an open position, half sections 30 and 31 abut at the center of the table at separation members 34 and form a substantially continuous horizontal table surface. Separation members 34 are carried on the inside edge of the innermost plank 12 and serve to maintain the same separation between the abutting surface planks 12 as between the other abutting surface planks. Stability near the corner regions of the table top is suitably provided in that the three internal surface planks 12 in the respective half sections rest upon the arm members of the other half section when the table is in an open position. The table edges 43, 44 formed by the ends of the exterior surface planks 12 are suitably rounded to minimize the likelihood of injury.

FIG. 2 illustrates a chair, shown generally at 50, which has substantially the same construction as the table described above. Except for size differences, a smaller number of surface planks 52, and the absence of a corresponding separation member 34 and cross member 25, the chair structure identically corresponds to the table structure.

Thus, it will be seen that both the table and the chairs are suitably constructed to be folded into a compact configuration wherein the half sections of the table top means are disposed substantially parallel with respect to each other and with respect to the folded support means as illustrated in FIG. 3. FIG. 9 shows a side view of the table in a folded position. A central opening, generally indicated at 42 in FIG. 4, is provided in the table between the folded half sections and the folded leg members which is adapted to receive and retain by conventional retainment means independent articles of all varieties. In a preferred embodiment, the independent articles received within said opening are the folded chairs of the invention which may be suitably arranged and securely disposed within the opening as shown in FIG. 3. In a preferred embodiment, the base chairs shown generally at A and B in FIG. 7 rest within the opening upon cross member 25. Upper chairs C and D rest upon the respective base chairs. Conventional securement means 72 is provided to secure the unit in a folded position and eliminate the possibility of either half section being swung outwardly open when the independent articles are enclosed within the folded table. The securement means also facilitates the transport and storage of the unit in a horizontal position. The table and corresponding chairs being constructed of a lightweight material, such as wood or a suitable lightweight metal, make the folded unit readily transportable and storable.

Figure 6:
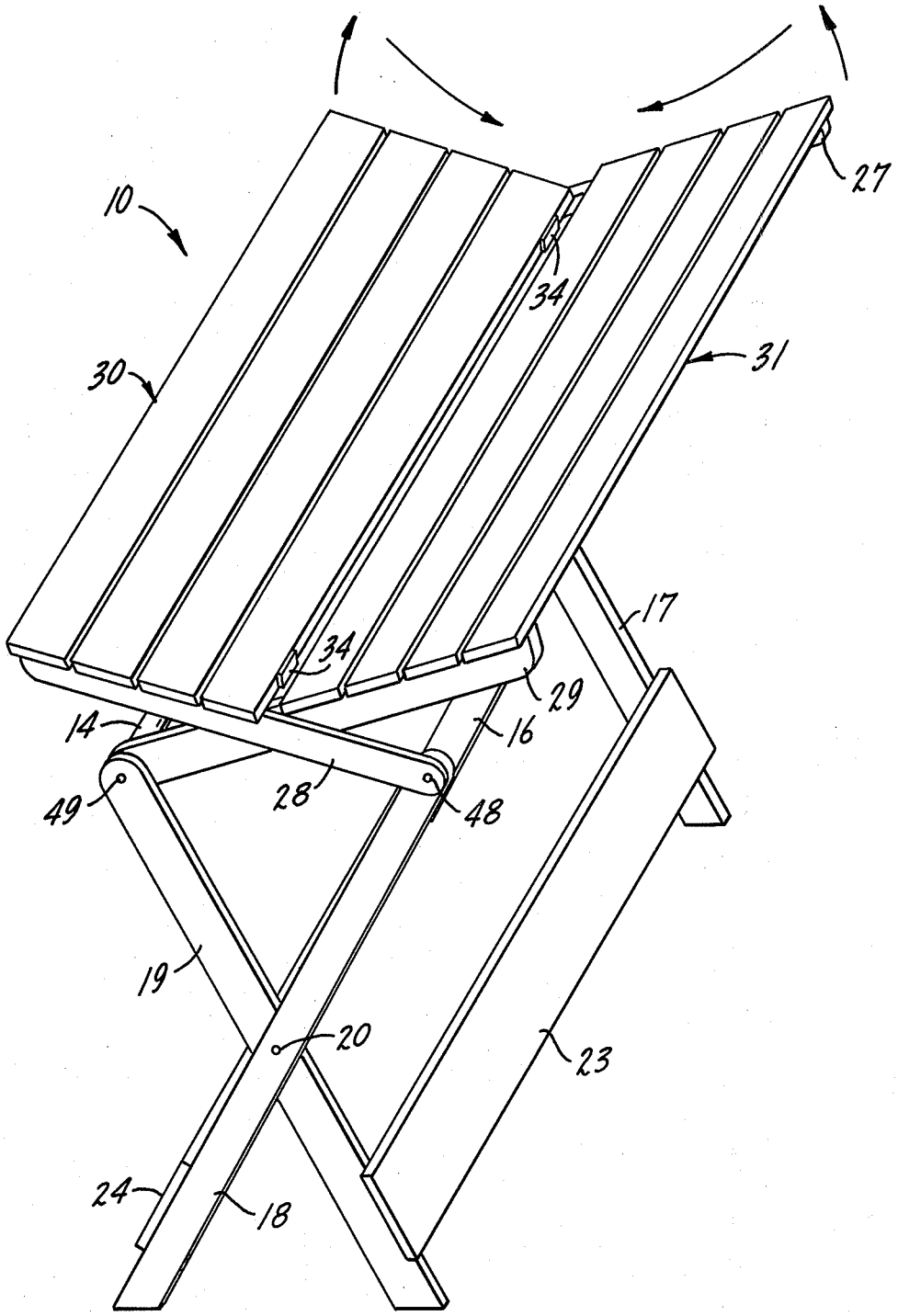

It will be appreciated that the folding mechanism of the table and, correspondingly the chairs, is quite simple. Referring to FIGS. 4–6, it can be seen that the table may be opened with a slight upward motion and gentle pushing together of the two half sections as illustrated by the directional force arrows in FIG. 6. The independent leg members in turn pivot about the pivot means and move outwardly in opposite directions. As the leg members continue to swing in opposite directions they draw the table top half sections together and down to abut at separation members 34 and thereby form a substantially continuous horizontal table top. The abutment of the table top half sections correspondingly stops the movement of the leg members and, in effect, locks the table in its open position. To close the unit, a corresponding opposite procedure is used.

It will be noted that although the table and chair set described herein shows a combination of 4-seat capacity table with four chairs, any suitable seat capacity and corresponding number of chairs may be devised.

Although preferred embodiments of the invention have been illustrated and described, it will at once be apparent to those skilled in the art that modifications and betterments of the invention may be made within the spirit and scope of the inventive concept.

It is intended that the scope of the invention be limited not by the scope of the foregoing exemplary description, but, rather by the scope of the hereinafter appended claims when interpreted in light of the pertinent prior art.

I claim:

1. A table and chair set, said set including, in combination a table, said table, in a collapsed condition, also functioning as a chair receptacle, said table including, a first pair of legs (19, 17), the upper end of each leg of said first pair of legs having a table arm (29, 27) pivotally connected thereto (49), said table arms comprising a first pair of table arms, the free, non-pivoted end of each table arm of said first pair of table arms carrying a first flat table top sub-assembly (31), a combined carrying and connecting rod (14) pivotally connected to, and extending between, the upper, pivoted end of each said first legs and the pivoted end of each associated table arm, the axis of the carrying/connecting rod being co-axial with the pivot axis at the pivot joinder of each leg of said first pair of legs and its associated table arm, whereby said combined carrying and connecting rod functions as a carrying handle for the table and chair set when the table is in a collapsed condition, and as a connecting rod which maintains the two table arms associated with the first pair of legs in a connected, but spaced, position with respect to one another in an erected condition, a second pair of legs (18, 16), the upper end of each leg of said second pair of legs having a table arm (28, 26) pivotally connected thereto (48), said just mentioned table arms comprising a second pair of table arms, the free, non-pivoted end of each table arm of said second pair of table arms carrying a second flat table top assembly (30), leg pivot connecting means (20, 15), each of said leg pivot connecting means connecting one of said first legs to one of said second legs, whereby said legs are connected, in pairs, about a common pivot axis, (20)

the two table legs and the two table arms at each end of the set being axially offset with respect to each other whereby said pairs of arms and legs at each end of the table formed by the abutment of the two table sub-assemblies swing in vertical, non-intersecting planes, (FIG. 6), the end edge portions of each table sub-assembly being supported by at least a portion of the pivotally connected table arm and table leg structure associated with the other table sub-assembly, a cross brace member (23, 24) extending between and connected to the lower end of each of the pair of table legs associated with each of the table top sub-assemblies, each cross brace member being located on the exterior side of an associated pair of table legs whereby said cross brace members are arranged in opposed, spaced relationship to one another when the table legs are vertically aligned with one another, and closure means (25) carried by at least one of said cross brace members and being arranged to form, with the cross brace members, a receptacle closed on the bottom and upwardly open therefrom on both sides of the bottom when the first and second pairs of legs are in a collapsed condition, said receptacle being of a width wide enough to receive and support one or more chairs which are collapsible by scissors actions to a width substantially no wider than the width of the legs and seat surface thereof, (FIG. 9), said carrying/connecting rod being located at the upper end portion of the collapsed table and the receptacle at the lower end portion of the collapsed table to thereby provide maximum access to the receptacle, and one or more chairs (A, B, C, D) formed and adapted to be collapsed to a width less than the width of the receptacle whereby it may be inserted from the top region downwardly into the receptacle, when either, or both, of table sub-assemblies (31, 30) are swung away from their downwardly collapsed position.

* * * * *